United States Patent [19]

Persbeck

[11] Patent Number: 4,597,563

[45] Date of Patent: Jul. 1, 1986

[54] TOOL HOLDER FOR THERMIC CUTTING RODS

[75] Inventor: Sven-Eric Persbeck, Torslanda, Sweden

[73] Assignee: Salen & Wikander AB, Solna, Sweden

[21] Appl. No.: 649,593

[22] Filed: Sep. 11, 1984

[30] Foreign Application Priority Data

Sep. 12, 1983 [SE] Sweden ..... 8304860

[51] Int. Cl.[4] ..... B23K 37/02

[52] U.S. Cl. ..... 266/77; 219/70

[58] Field of Search ..... 266/77, 48; 219/70

[56] References Cited

U.S. PATENT DOCUMENTS

| | | | |
|---|---|---|---|
| 3,751,625 | 8/1973 | Hummel et al. | 219/70 |
| 4,182,947 | 1/1980 | Brower | 266/48 |
| 4,477,060 | 10/1984 | Molinder | 266/48 |

FOREIGN PATENT DOCUMENTS

| | | | |
|---|---|---|---|
| 1573781 | 8/1980 | United Kingdom | 219/70 |

*Primary Examiner*—Melvyn J. Andrews

[57] ABSTRACT

Tool holder, preferably for a thermic cutting rod, having an attachment for the rear end of the rod, a supply of oxygen to the rear end of the rod passing through the same to its front end. There is a valve for controlling the oxygen supply, and a handle for the tool holder. The attachment itself comprises a sleeve which encloses with a seat the rear end of the tool thereby attaching the same, and which is movable from a front, loading position to a rear, working position of the rod. In the rear position the sleeve is pushed inwardly into a space, which can be placed under gas pressure, preferably by the above supply of oxygen, while in the front position the sleeve rests against a shoulder. A forward movement of the sleeve from the rear position to the rest position against the shoulder can be effected by the gas pressure and with such velocity that the rest of the rod, when it should be removed from the holder when the main part of the rod is consumed, will be thrown out of its seat in the sleeve.

4 Claims, 4 Drawing Figures

TOOL HOLDER FOR THERMIC CUTTING RODS

BACKGROUND OF THE INVENTION

The present invention relates to a tool holder, preferably for thermic cutting rods.

Certain types of tool holders are so designed that a tool can be held therein. Periodically the tool has to be changed either because another type of tool or a tool of different dimension has to be used, or because the tool is worn out. It is desirable that a change including removal of the first tool, can be made as rapidly and simply as possible. This has relevance for example in tools used as thermic cutting rods which are quickly consumed.

When cutting steel, concrete, and other materials, so-called thermic cutting rods are used. They consist of a rod of steel to the end of which oxygen is supplied. After ignition the rod will burn and will produce strong heat which is used for cutting. When cutting steel the oxygen will also initiate burning of the material to be cut, which increases the cutting effect. The oxygen will also blow away part of the melted material, which also will increase the effect obtained by the high temperature.

Oxygen is brought to the point of the rod by way of a longitudinal empty space in the rod so that the oxygen can be fed from the other end of the rod which is attached to a holder with a connection to an oxygen tube.

The rods are consumed relatively quickly during the cutting operation, which means that they have to be changed often. The function of the holder is relatively complicated: it has to hold the rod, supply the oxygen, provide a sealing function, and in certain cases also provide a connection to a source of current to the rod for ignition of the same. Certain rods are intended for electric ignition, which is especially suitable for underwater work where other means for ignition are difficult to use. This complicated function has made it difficult to add a mechanism for a fast and simple exchange of the rods. As a result of the fast consumption of rods the changes of the rods tend to be an inefficient, long part of the total work time. Naturally, this is a disadvantage of high degree in underwater work where the working periods are relatively short and the cost per hour is high.

The present invention has as its object to provide a holder for tools as thermic cutting rods which make a rapid and simple change of the tool possible so that more efficient work is obtained than is possible with known tool holders.

BRIEF SUMMARY OF THE INVENTION

The object of the invention is obtained by means of a tool holder, in which an attachment of the tool is effected by a forward movement from a rear position to a front position so that it rests against a shoulder by gas pressure with such velocity that the tool, for example the rest of the rod, if it is to be removed from the holder when the main part of the rod is consumed, will be ejected from its attachment by inertia force when stopping against the shoulder.

BRIEF DESCRIPTION OF THE DRAWING

In the accompanying drawing two embodiments of the invention are shown.

DETAILED DESCRIPTION OF A PREFERRED EMBODIMENT

Figure 1:
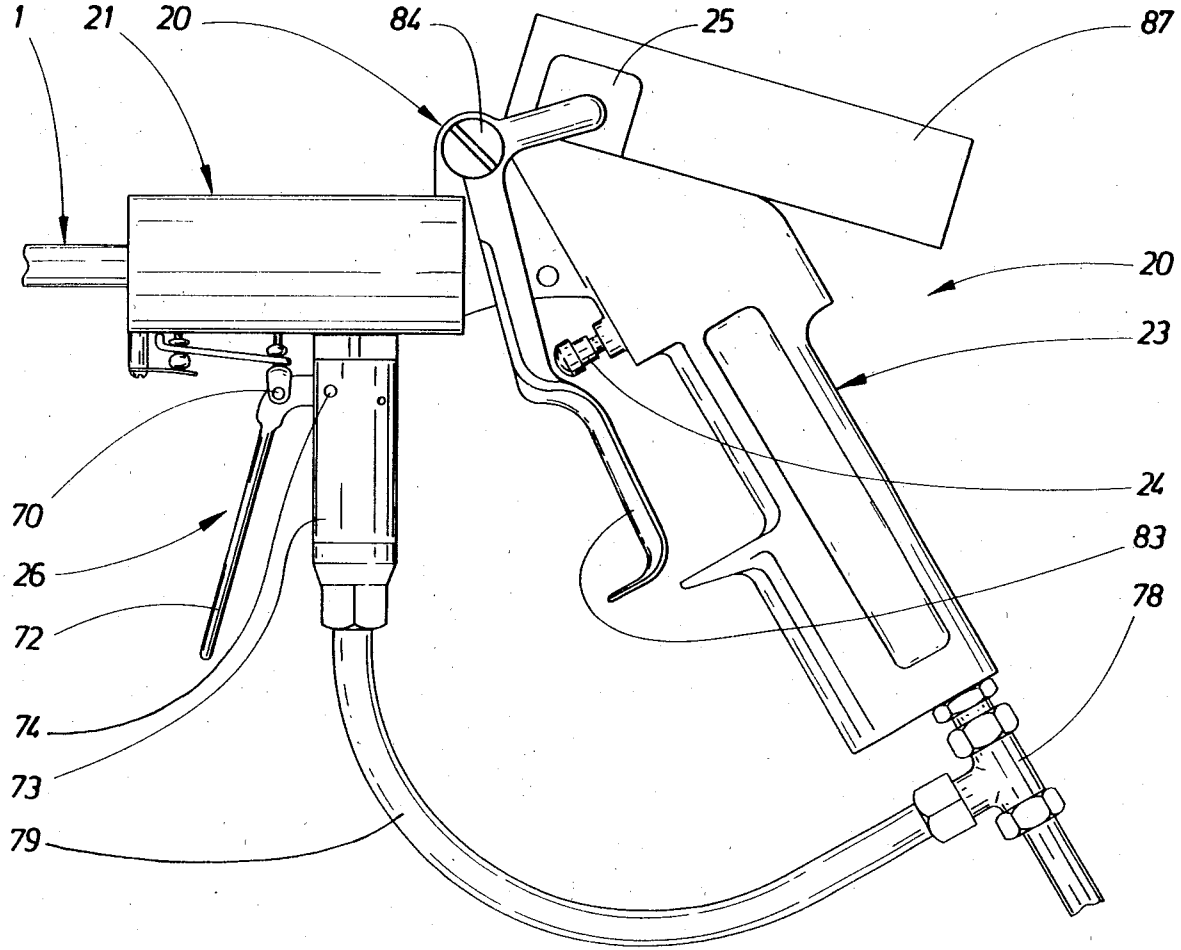
FIG. 1 is an elevational view of the holder.

In the drawing the tool, a thermic cutting rod, is designated by numeral 1. According to FIG. 2 it consists of a steel tube 2 which is provided with a front end 3 and a rear end 4. A bundle of steel wires 5 is inserted in the tube. The wires are shorter than the tube so that an empty space 6 is formed at the rear end 4 while at the front end 3 there is formed a space which is filled with a Thermit compound 7. Thermit is, as known, a mixture of aluminum and iron oxide which after lighting will burn with a very high temperature. Thermit 7 is separated from the environment by means of a plug 9 of a meltable mass, preferably a plastic mass. Preferably, the plug is produced by injection of a so-called fusible adhesive, and is secured by narrowing the front end 3 of the tube by pinching it.

A sleeve 10 of plastic is inserted in the rear end 4 of the rod. Adjacent to the rear end of sleeve 10 which is in line with the extreme end of the rod, there is inserted a metal sheet 11 from which two resilient tongues extend outwardly. To metal sheet 11 there is connected an insulated conductor 13. A second conductor 14 which does not necessarily have to be insulated, extends through the wall of sleeve 10 and is bent outwardly over the outside of the sleeve with its non-insulated end. The conductor 14 will consequently be pressed against the inner wall of the steel tube 2 and an electrical contact is obtained between these two elements. Conductors 13 and 14 are connected to each other within the Thermit compound 7 by means of an incandescent filament 15. The conductors extend along the rod in the spaces formed between the steel wires 5. These spaces also function as channels for the oxygen which has to be brought from the rear end 4 of the rod to its front end.

A holder for the rod is designated in FIG. 1 with 20. It consists of a number of main parts. The very rod holder is in the following called rod attachment 21, and is in turn attached to another main part which forms a handle 23. Furthermore a release device 26 is provided. By means of the handle the rod can be held with one hand. It is also provided with a valve device 24 and a switch means 25.

Figure 2:
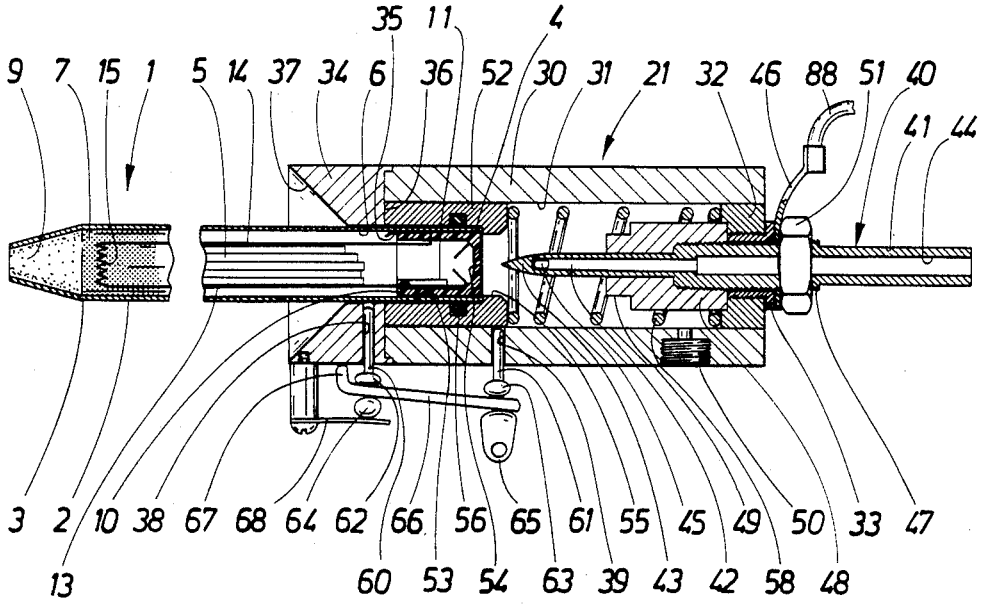
FIG. 2 is a sectional view of a part of the holder on an enlarged scale.

According to FIG. 2 the rod attachment has a metal sleeve 30 with an inner, cylindrical space 31, the end of which is defined by a rear wall 32 through which a hole extends. The sleeve ends at the front with an entrance part 34 with an inner hole 35 which has a diameter smaller than the diameter of space 31 so that a shoulder 36 is formed. At the outer end entrance part 34 has an entrance cone 37. A bore 38 extends radially through the wall of part 34. A corresponding bore 39 is provided in sleeve 30. Further, a bore 50 extends through the wall of sleeve 30 and is provided with a thread.

Through the hole in the rear wall 32 of the sleeve extends a tube 40, which has a rear portion 41, which allows connection to an oxygen supply, and a narrower front portion 42 which ends in a point 43. From rear portion 41 a bore 44 extends in tube 40 which at the front communicates with holes 45 directed sideways and positioned adjacent to point 43. Tube 40 extends through a nipple 33 of an insulating material and is provided with a thread 47 which is screwed into a body 48 of an insulating material, which forms an inner head for the tube 40 and which rests against the rear wall 32 of sleeve 30. At its inner end body 48 has a narrower portion 49. Thread 47 is also used to attach a nut 51 which via nipple 33 and a cable shoe 46 rests against the outside of rear wall 32, by means of which tube 40 is attached to sleeve 30 together with body 48. By means of nipple 33 and body 48 of insulating material, tube 40 is insulated from the other parts belonging to the device, which are manufactured of metal.

A movable sleeve 52 having a passage 53 is inserted in the cylindrical space 31. Sleeve 52 surrounds rod 1 with clearance. At the inner passage 53 there is a shoulder 54, which in turn blends into a hole 55. An O-ring 56 is inserted in a groove in passage 53. Between movable sleeve 52 and rear wall 32 of sleeve 30 there is inserted a pressure spring 58. This spring strives to hold the movable sleeve 52 resting against the shoulder 36.

A pin 60 extends through a bore 38 and a pin 61 through a bore 39. The pins are provided with an inner collar 62 and 63, respectively, and an outer head 64 and 65, respectively. Between the collar and the head there is situated a lever 66, which with play surrounds pins 60 and 61 and which with an end 67 rests against sleeve 30. Pins 60, 61 are biased by a spring 68 which is attached to the holder 20 and which strives to press the pin inwardly into the sleeve 30.

Lever 66 is connected by means of a pin 70 (FIG. 1) through head 65 with a manoeuvering arm 72, which is carried in a housing 73 of a releasing device 26 by means of a pivot 74. By means of the manoeuvering arm a valve in the housing 73, which is connected to bore 50 in sleeve 33 can be manoeuvered. The function of the valve will be explained in the following. The manoeuvering arm 72 forms a releasing organ and forms together with pins 60,61, valve 73 and lever 66 the releasing device 26.

From the outer end of handle 23 there extends a nipple 78 which through a channel 75 (FIG. 4) is connected to valve means 24. Nipple 78 is preferably made as the male part of a quick-coupling intended for the supply of oxygen from a container through the valve means. The gas is supplied through a valve and the tube 40 to the rod attachment 21.

The nipple 78 is via a branch conduit 79 also connected to the releasing mechanism 26.

Figure 4:
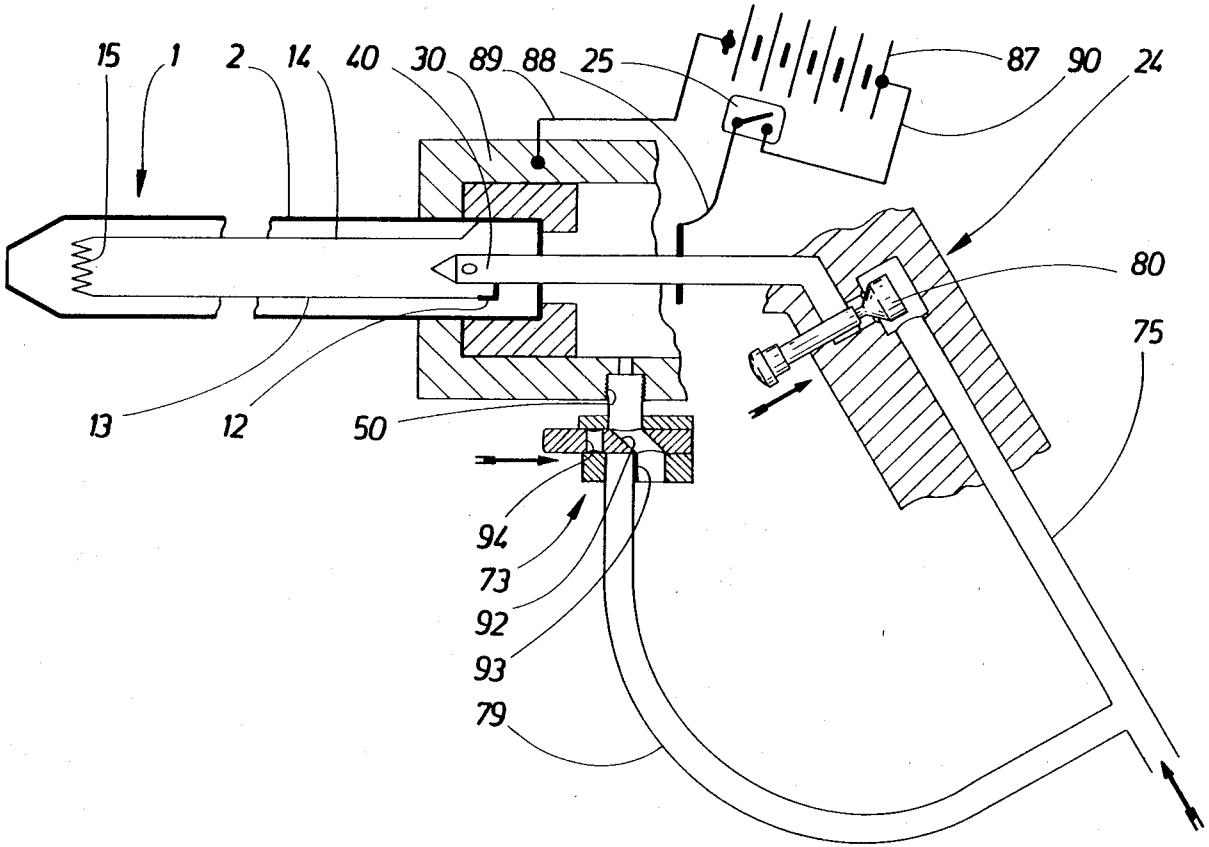
FIG. 4 is a schematic view of the functional parts of the holder.

The valve, the valve body of which has the numeral 80 in FIG. 4, is biased by spring force to be in a closed position. It can however be opened by pressing a key 83 which is carried in the housing by means of a shaft 84. By pressing the key 83 which is positioned in handle 23 one can consequently open the valve in the valve means and a free passage is obtained from the nipple 78 via the channel 75 to the tube 40 of the rod attachment. If key 83 is released the valve is closed. In spite of this a small opening is left, which however only allows at a predetermined low pressure a very small flow. This is obtained by means of an adjusting screw preventing the valve body from reaching a completely closed position.

Switch means 25 consists of an electric switch which when not actuated is in open position but, when key 83 is pressed closes an electric circuit including a conductor 88 which is in contact with tube 40 to the rod attachment 21 via cable shoe 46 and nut 51 and a second conductor 89 which is in contact with metal sleeve 30. The circuit is intended to be connected to a battery 87 which is carried by the holder.

The arrangement is shown in a schematic view in FIG. 4. Accordingly ,there are shown both conductors 13 and 14, which are connected via incandescent filament 15. Also shown is how the metal sheet 11 can obtain contact with tube 40 so that the same also is in contact with conductor 13. Conductor 14 in turn has contact with tube 2 of rod 1, which in turn has contact with sleeve 30 in rod attachment 21. Tube 40 is via conductor 88 and switch means 25 and via a cable 90 connected to one pole of battery 87. Sleeve 30 in turn is in contact with the other pole of the battery. FIG. 4 also shows the valve means 24 with the valve being manoeuverable by means of key 83 and provided in valve body 80. Key 83 is further connected to electric switch 25. This is provided to close the circuit by means of a relay, not shown, whereby current can be transmitted from the battery to incandescent filament 15 via tube 40 and sheet 11 in the rod, and via sleeve 30 and the outer wall of the rod. The relay is however provided only to initiate a brief supply of a current, immediately after the key has been depressed. This can in a known way be accomplished by means of a time switch or by discharging a condensor charged by the battery.

Also shown is the manoeuvering arm 72 connected to valve 73. As evident the valve, in released position of arm 72, leaves a channel 92 open between the inner wall of sleeve 30 via bore 50 and a discharge opening 93. If arm 72 is actuated this free discharge channel will be closed and instead a discharge channel 94 from the oxygen source is opened so that oxygen will be passed through the hole 50 into the interior of the sleeve 30.

Figure 3:
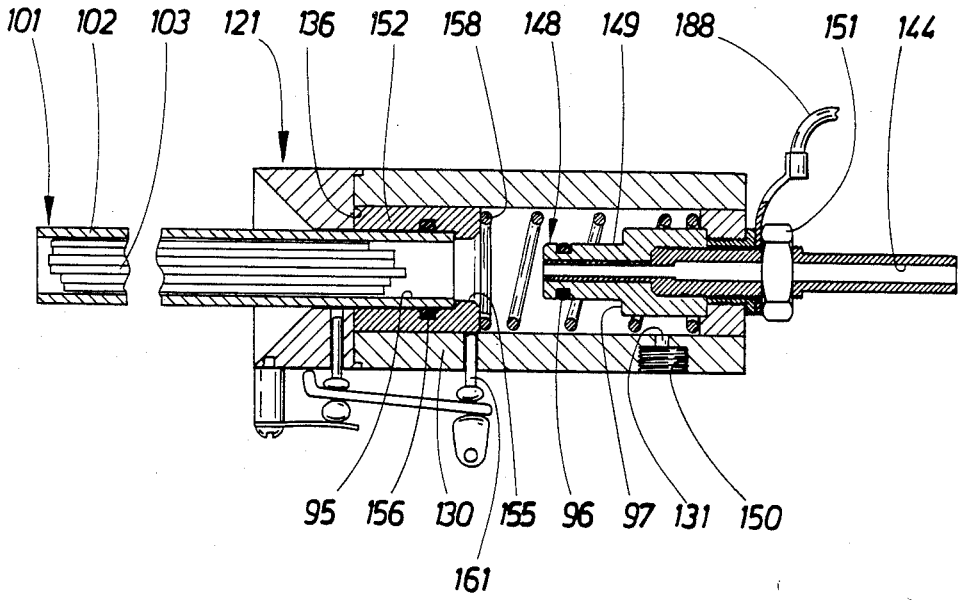
FIG. 3 shows a variation in the same way.

The embodiment shown in FIG. 3 is intended for a type of rod different from the one described before. To a large extent however the holder is similar to the described one and the changes are restricted to the rod attachment. Parts which are equal to the part of rod attachment 21 are referred to with the same numerals, plus one hundred. The rod attachment is consequently referred to as 121 and the rod 101, and so on.

The differences are that rod 101 is not intended to be ignited by a built-in Thermit charge but instead by being connected with its rear end to one pole of a current source of high amperage and by pressing the point of the rod against a metal body which is connected to the other pole of the current source. Thereby, the rod point is heated, which will result in ignition if oxygen is applied at the same time. For the holder there is consequently no certain ignition mechanism necessary and the function of the switch, to provide current in a short period, is no longer relevant.

With this form of rod it is not necessary that the inner space of the same is closed and it ends instead in a space 95 which is open towards the rear. Further, the rear end of the rod will, as described before, be introduced into a movable sleeve, here referenced 152, provided with a rear through-hole 155. Behind sleeve 152 there is located a body 148 with a through-hole 144 for ingress of oxygen. As a difference from body 48, body 148 is made of a conducting material and has on a front portion 149 an O-ring 96. Front portion 149 ends backwards in a shoulder 97, and is adapted to be inserted in space 95 in rod 101 and sealing will be effected by O-ring 96. Also in this case, the inner space 131 of rod attachment 121 has a connection through a hole 150 with valve 93 of the release mechanism.

When there is no rod inserted in the rod attachment 21 body 52 is located in the shown front position, under the influence of spring 58. When a rod is inserted, in underwater work, water trapped in space 31 will escape via valve 73 through outlet opening 93. Tube 40 will be kept free of water through a minor flow of oxygen which is applied through valve 24 also when key 83 is not actuated.

When the rod is to be attached it is introduced into entrance cone 37 through hole 35 and into hole 53, which with its shoulder 54 forms a seat for the end of the rod. In this seat the rod is sealed by means of O-ring 56. By pushing in the rod further body 52 will be brought to rest against body 48 against the force of spring 58, whereby a shoulder 42 on body 48 will provide further sealing by being introduced into hole 55. As is evident from the figures point 43 of tube 40 will by this insertion be pressed through the rear wall of the plastic sleeve 10 and will be introduced into the empty space 6 in the rod and the point will at the same time rest against the tongues of sheet 11. The interior of the rod is dry because it is sealed by means of plastic sleeve 10 and plug 9.

Prior to the backward movement of movable sleeve 52 pin 61 rests against its periphery under the force of spring 68. When the sleeve has been pushed backwards to said rear position its front edge will reach behind pin 61. Spring 68 thereby pushes the pin inwardly in front of sleeve 52. When pin 61 was resting against sleeve 52 even pin 60 was arrested in an outer position in which it was freed from the rod inserted in hole 35. Upon pushing inwardly pin 61, also pin 60 will make an inward movement. This will result in the pin being pressed against the rod in hole 35. As a result of the position of the bearing of lever 66 in its carrying part 67 the movement of pin 60 will be considerably smaller than that of pin 61 while the spring force from spring 68 is considerably higher at pin 60 than at pin 61, which is the intention. By means of the position of pin 61 in front of sleeve 52 the same will be arrested in its rear position against the force of spring 58.

In the rear position of the rod and of the sleeve 52 a current flow is produced from battery 87 through switch 25 to tube 40, via point 43, sheet 11 and conductor 13 to incandescent filament 15 and in return via conductor 14 to the outer tube of the rod and from the same to metal pin 60 which is pressed against the rod, to sleeve 30 and back to the battery via said conductors. If switch 25 is closed by pushing the manoeuvering key 83 inwards a short current flow will be produced by means of the relay from the battery and through incandescent filament 15 and Thermit compound 7 will be ignited. However, if the rod should be ignited it is necessary that oxygen is supplied. This will occur at the same time by means of the pushing in of the key 83 so that body 80 is opened. Hereby, the oxygen will flow in without obstacle through tube 40 and out through holes 45, which are situated in space 6 in the rod.

Through the spaces between wires 5 the oxygen can flow further to point 43 of the rod. For the ignition of the rod one has consequently to push in key 83. By means of the Thermit the rod will be ignited whereby meltable plug 9 will open the outer end of the rod so that the oxygen can flow through and maintain the burning and blow away the melted material.

When the rod has burnt so much that the steel wires 5 have been consumed, that is close to the rod attachment, the burning will decrease and the rod has to be changed. This will be obtained by hitting with the manoeuvering arm 72 against an object of any kind. In the described position arm 72 is pivoted in a forward position since lever 66 was pressed upwards when pin 61 fell down in front of sleeve 52, a movement which influenced arm 72 via pin 70. By this strike against release arm 72 lever 66 will be pulled to the position shown in FIG. 1. Thereby, pin 61 will be drawn out and will free the sleeve at the same time as pin 60 will be moved away from the outside of the rod. This in turn results in the spring 58 beginning to move sleeve 52 and thereby also the rod forwards. As has been mentioned the body 73 will be opened by the influence of arm 72 so that oxygen will be introduced into the space in sleeve 30. As the oxygen has a high pressure sleeve 52, the hole 55 of which is closed by the rod which in turn is sealed by means of O-ring 56, will be influenced by large outwardly directed forces, which results in that the sleeve will be thrown fast forwards and will hit shoulder 36. Thereby, such large mass forces are produced that the stub of the rod, which substantially only is arrested by ring 56, is thrown out of the seat, which the hole 53 forms. Consequently, the rod is now ejected, and a new rod can be inserted in the way described before. Of the oxygen supply to the holder a small flow is maintained, resulting in that the tube 40 all the time is filled with oxygen, even when the manoeuvering key is released.

At the other embodiment, according to FIG. 3, rod 101 will, upon being pushed backwards, together with sleeve 152 and front portion 149 of body 148, be brought into the rear space 95 of the rod by being sealed relative to space 131 by means of O-ring 96. Sleeve 152 is arrested in its rear position by pin 161, as described before.

In this position oxygen can be supplied in the way described before through hole 144 to the interior of the rod. By ignition of the rod, current is supplied via metallic body 148 to the wall of the rod tube 102. The ignition may then be effected in the described way by bringing the point of the rod in contact with a current-carrying body. When the rod has to be thrown out oxygen will, as described before, be supplied through hole 150 at the same time as pin 161 will be drawn out. The entire process will be effected by means of the releasing arm 72. The inserted spring 158 strives to press sleeve 152 outwardly at the same time as the oxygen in space 131 strives to press the sleeve forwardly, with great force over the entire distance, as the sleeve and the rod are sealed by means of O-ring 96. Thereby, the above-described fast throwing forwards of the sleeve, together with the rod, is effected, which resuts in throwing out the stub of the rod when the sleeve hits shoulder 136.

In the foregoing, two preferred embodiments of the holder have been described. Through these a connection of the rod to the supply of oxygen and also an electric connection of the ignition system of the rod is obtained when the rod is inserted. These can be made in one single manipulation. Furthermore, a very simple and fast ejection of the stub of the rod is obtained by means of a hit against the releasing key, without any touching of the hot stub of the rod being necessary. Also, although a device including all these functions represents a very effecient tool, it is possible to utilize only some of the functions and in spite of this obtain major advantages from an efficiency point of view.

Accordingly, rods without an electric ignition system are provided, and in such rods no switch means will be provided for such a system. In spite of this it is possible by means of suitable modification to utilize the idea behind the invention, that the oxygen pressure is used for throwing out the rod. This can be done in the shown way by inserting the rod in a movable sleeve, which can be thrown forwards under influence of the oxygen pressure, so that the stub of the rod will be thrown out of its seat under the simultaneous influence of the gas pressure.

I claim:

1. A holder for comprising: an attachment for the rod, a sleeve in said attachment for enclosing a rear end of the rod to form a seat therefor, said attachment having a shoulder, means for supplying gas under pressure to said sleeve for passage into the rod from said rear end, said sleeve being movable from a front position for receiving the rod to a rear position forming the working position of the rod, in said rear position said sleeve being located in said attachment in a space connected to said supply means, and in said front position said sleeve resting against said shoulder, said sleeve being movable from said rear position by pressure from said supply means to said front position against said shoulder, impact against said shoulder by said sleeve ejecting the cutting rod from said seat out of said sleeve.

2. A holder according to claim 1, comprising spring means in said attachment for biasing said sleeve towards said front position, and ratchet means for locking said sleeve in said rear position, release of said ratchet means, while maintaining gas pressure in said space, effecting movement of said sleeve into said front position.

3. A holder according to claim 2, wherein said gas supply means comprises an element with a point, and adjacent said point a number of discharge openings for gas, said point being positioned within said sleeve when said sleeve is in said rear position, to pierce the rod.

4. A holder according to claim 3, for a thermic cutting rod which has an electrically conductive outer wall and also has ignition means to be activated by an electric current, said holder having a first electric connection located at said attachment, and a second electric connection at said outer wall, said supply means being connectable to one pole of a source of current when piercing the rod while said sleeve has electric contact with said outer wall to be connectable to the other pole of the source of current, whereby current from said source will flow to said ignition means via said supply means and said sleeve.

* * * * *